US006681745B2

(12) United States Patent
Hozuki

(10) Patent No.: US 6,681,745 B2
(45) Date of Patent: Jan. 27, 2004

(54) FUEL INJECTION APPARATUS FOR INTERNAL COMBUSTION ENGINE

(75) Inventor: Takashi Hozuki, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/212,047

(22) Filed: Aug. 6, 2002

(65) Prior Publication Data

US 2003/0150428 A1 Aug. 14, 2003

(30) Foreign Application Priority Data

Feb. 8, 2002 (JP) ..... 2002-032012

(51) Int. Cl.[7] ..... F02D 41/14

(52) U.S. Cl. ..... 123/486; 701/104; 701/115; 123/674

(58) Field of Search ..... 123/486, 674; 701/104, 115

(56) References Cited

U.S. PATENT DOCUMENTS 4,245,312 A * 1/1981 deVulpillieres ..... 123/486
5,434,779 A * 7/1995 Vukovich et al. ..... 123/674
5,713,332 A * 2/1998 Adler et al. ..... 701/104
6,237,567 B1 * 5/2001 Nakano et al. ..... 123/486
2003/0093215 A1 * 5/2003 Jankovic et al. ..... 701/115
2003/0144788 A1 * 7/2003 Brackney et al. ..... 701/115

FOREIGN PATENT DOCUMENTS

JP 01-130042 5/1989

* cited by examiner

*Primary Examiner*—Erick Solis
(74) *Attorney, Agent, or Firm*—Sughrue Mion, PLLC

(57) ABSTRACT

A fuel injection apparatus for an engine includes various sensors (10), a control unit (20) and an injector (30). The control unit (20) includes a basic fuel injection quantity arithmetic means for determining a basic injection quantity conforming to the operation state, a data map (21) holding data for determining a regulating correction quantity in accordance with specific engine parameters (Th, Ne), and a correcting arithmetic means for determining the injection quantity by correcting the basic injection quantity with the data. The data map (21) includes plural areas for holding the data. Intermediate areas holding no data are provided between two adjacent data holding areas. The correcting arithmetic means includes a search means for determining interpolation data corresponding to the intermediate area through interpolation based on the data stored in two adjacent areas. The injection quantity for the intermediate area is determined by correcting the basic injection quantity with the interpolation data.

4 Claims, 5 Drawing Sheets

CO REGULATING CORRECTION QUANTITY MAP

| deg \ Ne | ≦Ne1 | Ne2～Ne3 | Ne4≦ |
|---|---|---|---|
| ≦Th1 | D1′ | D2′ | D3′ |
| Th2～Th3 | | | |
| Th4≦ | | | |

CO REGULATING CORRECTION QUANTITY MAP

| deg \ Ne | ≦Ne1 | Ne2 | Ne3 | Ne4≦ |
|---|---|---|---|---|
| ≦Th1 | D1 | D2 | D3 | D4 |
| Th2 | D5 | D6 | D7 | D8 |
| Th3 | D9 | D10 | D11 | D12 |
| Th4 | D13 | D14 | D15 | D16 |

FUEL INJECTION APPARATUS FOR INTERNAL COMBUSTION ENGINE

This application is based on Application No. 2002-32012, filed in Japan on Feb. 8, 2002, the contents of which are hereby incorporated by reference.

BACKGROUND OF THE INVENTION

1. Field of the Invention

The present invention relates to a fuel injection apparatus for an internal combustion engine for controlling a fuel injection quantity on the basis of data corresponding to CO (carbon monoxide) regulating correction quantities. More particularly, the present invention is concerned with a fuel injection apparatus for an internal combustion engine in which data input processing and data search processing are moderated while the amount of data to be held is decreased for thereby realizing implementation of the fuel injection apparatus at a low cost without impairing accuracy of the fuel injection control.

2. Description of Prior Art

In general, in the fuel injection apparatus for the internal combustion engine, the fuel injection quantity is arithmetically determined or calculated in dependence on the operation state of the internal combustion engine determined on the basis of the detection information outputted from various type of sensors. In that case, with a view to decreasing the discharge quantity of CO (carbon monoxide) contained in the engine exhaust gas, a basic fuel injection quantity is additively corrected with map data (CO regulating correction quantity data) which also depends on the operation state of the engine, whereby the fuel injection quantity is optimally adjusted or regulated.

Through the procedure mentioned above, influence of dispersion of the engine and the various types of sensors can be canceled out or compensated for, and thus it becomes possible to control the fuel injection quantity with high accuracy in conformance with the operation state of the engine.

For better understanding of the concept underlying the present invention, description will first be made of a conventional fuel injection apparatus for an internal combustion engine known heretofore. FIG. 4 of the accompanying drawings is a block diagram showing schematically and generally a conventional fuel injection apparatus for the internal combustion engine.

Referring to FIG. 4, the internal combustion engine (hereinafter also referred to simply as the engine) is provided with various types of sensors for detecting the operation state of the engine, as generally designated by a reference numeral 10, a control unit which may be constituted by a microprocessor or microcomputer 20 for arithmetically determining engine control quantities in dependence on the operation states of the engine, and a fuel injector 30 for injecting fuel into the engine.

The various types of sensors 10 include a throttle position sensor 11 for detecting an opening degree Th of a throttle valve (not shown) and a crank angle sensor 12 for detecting a rotation number or speed Ne [rpm] of the engine. The throttle opening degree Th and the rotation speed Ne [rpm] of the engine are inputted into the microcomputer 20 together with other sensor information indicative of the operation state of the engine.

The microcomputer 20 incorporates an EEPROM (Electrically Erasable and Programmable ROM) 21 as a storage means for storing or holding therein the results of the arithmetic operations (i.e., various control quantities).

Further, connected to the microcomputer 20 is an external terminal unit 40 which may be constituted by a computer so that bi-directional data communication can be effectuated between the external terminal unit 40 and the microcomputer 20 through the medium of a serial communication interface.

Set previously in the EEPROM 21 which belongs to the microcomputer 20 are basic fuel injection quantities in correspondence to the operation states, respectively, of the engine.

In this conjunction, it should be added that the EEPROM 21 also serves as a data map means for holding individual data (described later on) corresponding to the CO regulating correction quantities in a plurality of areas as determined in dependence on the throttle opening degree Th and the engine rotation speed Ne [rpm].

The microcomputer 20 is comprised of a basic fuel injection quantity arithmetic means for calculating (i.e., arithmetically determining) basic quantity of fuel injected from the fuel injector 30 on the basis of the operation state of the engine and a correcting arithmetic means for arithmetically determining the fuel injection quantity by additively correcting the basic fuel injection quantity with the data corresponding to the relevant area of the EEPROM 21.

The microcomputer 20 is so arranged as to reference the data values stored in the EEPROM 21 on the basis of the operation state determined from the output of the various types of sensors 10 to thereby arithmetically determine the final fuel injection quantity.

Next, referring to FIGS. 5 to 7 of the accompanying drawings together with FIG. 4, description will be directed to the fuel injection quantity control operation carried out by the conventional fuel injection apparatus for the internal combustion engine.

FIG. 5 is a flowchart for illustrating a fuel injection quantity calculation routine executed by the microcomputer 20.

Further, FIG. 6 is a view for illustrating a data map of the CO regulating correction quantity known heretofore, and FIG. 7 is a view for illustrating data values at individual points based on the data map shown in FIG. 6.

Referring to FIGS. 6 and 7, data D1 to D16 for the CO regulating correction quantity are arrayed in a three-dimensional data map with the throttle opening degree Th and the engine rotation speed Ne [rpm] being used as parameters, wherein sixteen areas determining the individual data D1 to D16, respectively, result from division by four throttle opening degrees Th1 to Th4 on one hand and four engine rotation speeds Ne1 to Ne4 on the other hand.

At this juncture, it is noted that the relation among the throttle opening degrees Th1 to Th4 is given by $$Th1<Th2<Th3<Th4.$$

Further, relation among the engine rotation numbers or speeds Ne1 to Ne4 is given by $$Ne1<Ne2<Ne3<Ne4.$$

In more concrete, the throttle opening degrees and the engine rotation speeds may be set, by way of example, as follows:

Th1=10 [deg]

Th2=12 [deg]

Th3=30 [deg]

Th4=32 [deg]

Ne1=3000 [rpm]
Ne2=3200 [rpm]
Ne3=4500 [rpm]
Ne4=4750 [rpm]

In the exemplary case mentioned above, in the area for the data D1 shown in FIG. 6, the throttle opening degree Th is not greater than Th1 [deg] with the engine rotation speed Ne being not greater than Ne1 [rpm]. This area thus corresponds to an idling and low-speed operation range.

Further, in the areas corresponding to the data D4, D8 and the like, the engine rotation speed is not higher than Ne4 [rpm] and represent a high-speed operation range.

Further, the data D2, D3 and the like are represented by point data values (see FIG. 7) in point regions determined by the throttle opening degree and the engine rotation speed. In this case, the data value within a range of the engine rotation speeds [rpm] Ne2 to Ne3 can be determined through a linear interpolation calculation between two points.

Furthermore, in FIG. 7, individual CO regulating correction quantity data values exist at the prints (grids), respectively, which are determined by the throttle opening degrees Th1 to Th4 and the engine rotation speeds [rpm] Ne to Ne4, respectively.

Now referring to FIG. 5, the basic fuel injection quantity and the various correcting values for the basic fuel injection quantity are arithmetically determined or calculated on the basis of the input information from the various types of sensors 10 (indicating the engine operation state) in a step S1, which is then followed by a step S2 where the CO regulating correction quantity conforming to the throttle opening degree Th and the engine rotation speed Ne [rpm] are arithmetically determined.

In this conjunction, it is to be mentioned that the CO regulating correction quantity can be determined by referencing the data value of the CO regulating correction quantity map (map data stored in the EEPROM 21) (FIG. 6) in dependence on the throttle opening degree Th and the engine rotation speed Ne [rpm] (i.e., with the throttle opening degree Th and engine rotation speed Ne being used as parameters).

Next, the value resulting from addition of the CO regulating correction quantity to the basic fuel injection quantity is multiplied by the relevant various correcting values, the resulting value being then outputted as the final fuel injection quantity (step S3), whereupon the processing routine shown in FIG. 5 comes to an end.

In succession, the microcomputer 20 outputs the control value corresponding to the fuel injection quantity to thereby drive the fuel injector 30.

Next, description will be made of the data input processing generally executed upon shipping of the fuel injection apparatus for the internal combustion engine.

Upon shipping of the engine, the fuel injection quantity containing the CO regulating correction quantity (the value arithmetically determined or calculated on the basis of the current throttle opening degree Th and engine rotation speed Ne [rpm]).

In succession, in the engine operation state mentioned above, the CO discharge quantity contained in the exhaust gas is measured by means of a CO concentration measuring instrument, whereon the map data values of the CO regulating correction quantities in the individual areas are so altered or modified that the optimum air-fuel ratio can be realized. By storing the optimum CO regulating correction quantity data in the EEPROM 21, the CO regulating correction quantities are altered. In other words, the precision or accuracy of fuel injection control is improved by altering or modifying the fuel injection quantity.

In that case, alteration or modification of the CO regulating correction quantities (data values) stored in the EEPROM 21 as well as writing there of is performed by connecting the external terminal unit 40 to the microcomputer 20 by way of a serial communication interface.

As can be appreciated from the above, the conventional fuel injection apparatus for the internal combustion engine suffers a problem that the EEPROM 21 must necessarily be implemented with a large capacity because for all the points (grids) comprised of the throttle opening degrees Th1 to Th4 at the four points along the ordinate and the engine rotation speeds Ne1 to Ne4 at the four points along the abscissa, all the sixteen data D1 to D16 have to be held in the EEPROM 21.

Furthermore, because it is required to adjust the air-fuel ratio and rewrite the data in all the areas when the data for the CO regulation are altered, lots of time is taken for the processings involved.

SUMMARY OF THE INVENTION

In the light of the state of the art described above, it is an object of the present invention to provide a fuel injection apparatus for an internal combustion engine for which the data input processing and the data search processing and hence the cost can be reduced by decreasing the amount or number of the data to be held without impairing the precision or accuracy of the fuel injection control.

In view of the above and other objects which will become apparent as the description proceeds, there is provided according to a general aspect of the present invention a fuel injection apparatus for an internal combustion engine, which apparatus includes various types of sensors for detecting operation state of the internal combustion engine, a control unit for arithmetically determining a fuel injection quantity to be injected into the internal combustion engine in dependence on the engine operation state, and a fuel injector for injecting the fuel into the internal combustion engine in conformance with the fuel injection quantity determined arithmetically. In the fuel injection apparatus mentioned above, the control unit is comprised of a basic fuel injection quantity arithmetic means for arithmetically determining a basic fuel injection quantity in dependence on the engine operation state, a data map means for holding a plurality of data for determining a regulating correction quantity in dependence on specific parameters of the engine operation state, and a correcting arithmetic means for determining the fuel injection quantity by correcting the basic fuel injection quantity with the data. The data map means mentioned above includes a plurality of areas for holding the data, wherein the plurality of areas have intermediate areas holding no data between two adjacent areas. The correcting arithmetic means mentioned above includes a map search means for arithmetically determining interpolation data corresponding to the intermediate area through interpolation arithmetic based on the data stored in the two adjacent areas, respectively. The fuel injection quantity corresponding to the intermediate area is determined by correcting the basic fuel injection quantity with the interpolation data.

The fuel injection apparatus according to the present invention described above, the number of data to be held can significantly be decreased, allowing the apparatus to be implemented at a low cost without impairing the fuel injection control accuracy.

In a preferred mode for carrying out the invention, the data for the fuel injection apparatus correspond to a carbon monoxide regulating correction quantity for reducing the discharge quantity of carbon monoxide contained in the exhaust gas of the internal combustion engine. As the specific parameters mentioned previously, a throttle opening degree and an engine rotation speed [rpm] of the internal combustion engine are employed. The data map means is so designed as to hold the carbon monoxide regulating correction quantities corresponding to the throttle opening degree and the engine rotation speeds in the form of a three-dimensional data map.

In another preferred mode for carrying out the invention, the correcting arithmetic means of the fuel injection control apparatus is so designed as to arithmetically determine the fuel injection quantity by adding the data or alternatively the interpolation data to the basic fuel injection quantity.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
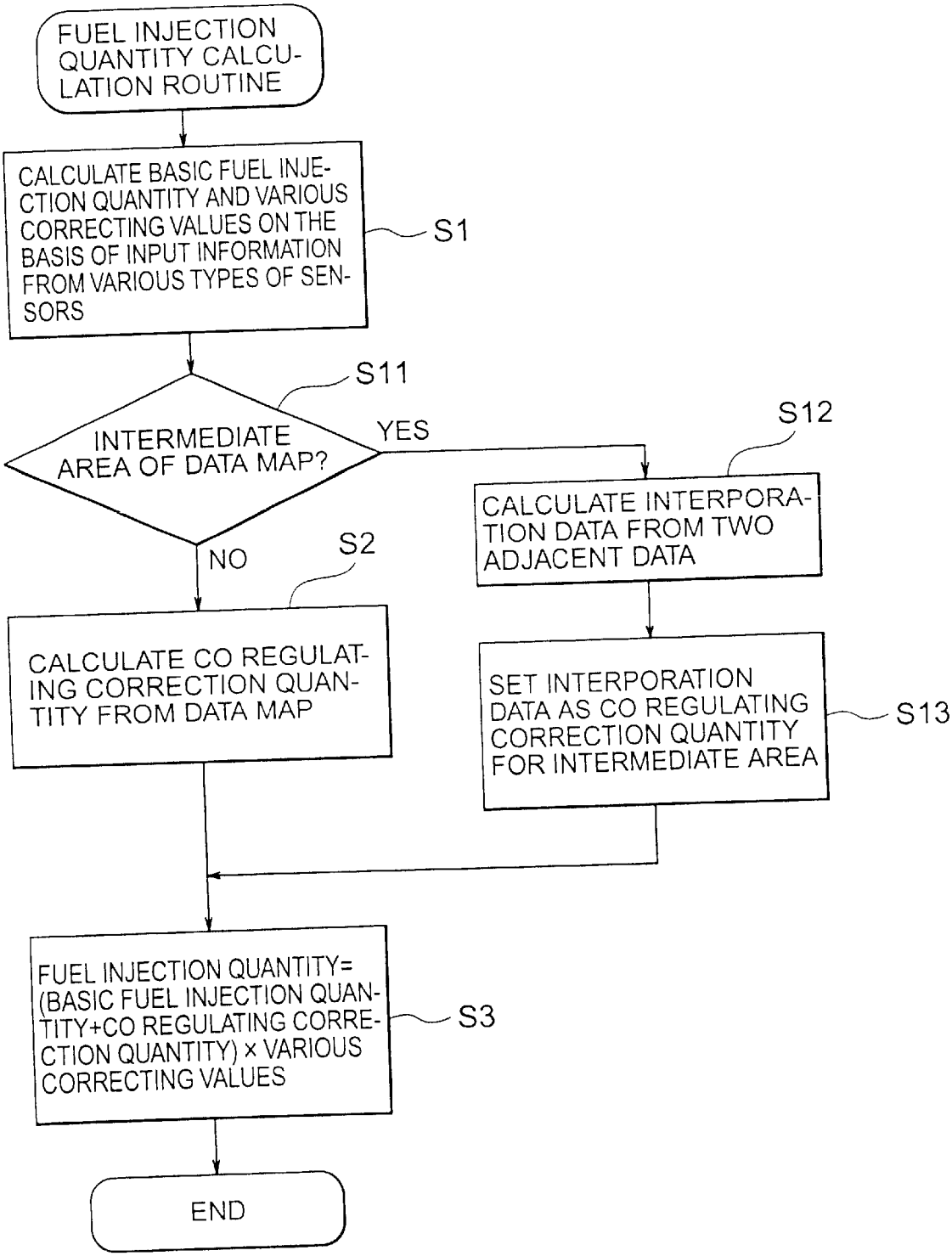
FIG. 1 is a flow chart for illustrating a fuel injection quantity calculation routine in a fuel injection apparatus for an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Figure 4:
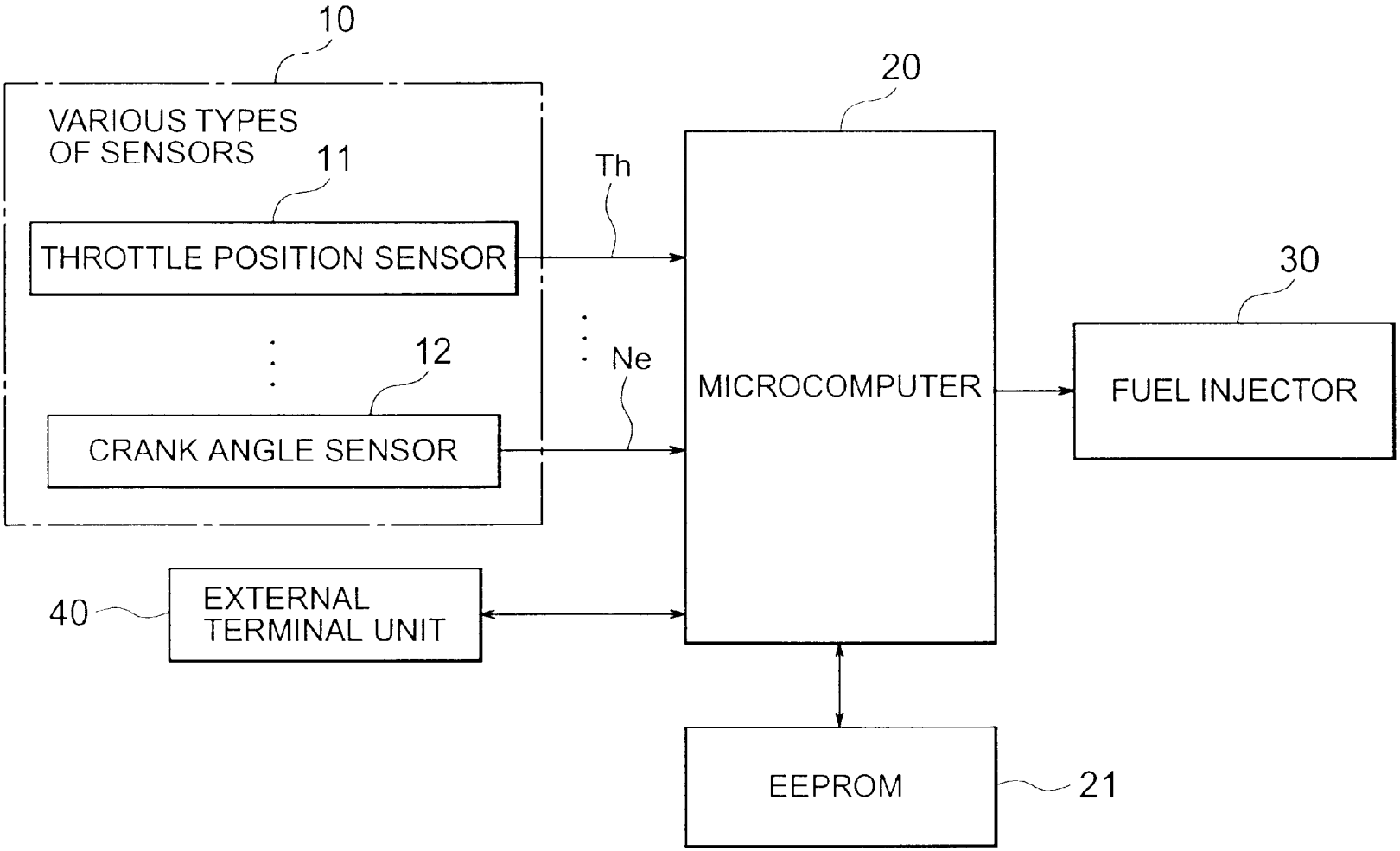
FIG. 4 is a block diagram showing schematically a configuration of a fuel injection apparatus for the internal combustion engine in general.

Now referring to the drawings, description will be made of the fuel injection apparatus for the internal combustion engine according to a first embodiment of the present invention. The system configuration of the fuel injection apparatus for the internal combustion engine now under consideration is essentially same as the one described previously by reference to FIG. 4 except for differences in respect to the function of the microcomputer 20 and the storage capacity of the EEPROM 21.

In the fuel injection apparatus for the internal combustion engine according to the instant embodiment of the invention, the correcting arithmetic means incorporated in the microcomputer 20 (see FIG. 4) includes a map search means for arithmetically determining interpolation data corresponding to an intermediate area of two adjacent areas through interpolation calculation based on the data stored in the two adjacent areas of the EEPROM 21.

Further, the EEPROM 21 provided in association with the microcomputer 20 stores therein the data corresponding to the CO regulating correction quantity at the time when the internal combustion engine is shipped, as described hereinbefore. Accordingly, the correcting arithmetic means is capable of arithmetically determining the fuel injection quantity corresponding to the intermediate area by adding the interpolation data to the basic fuel injection quantity.

Figure 5:
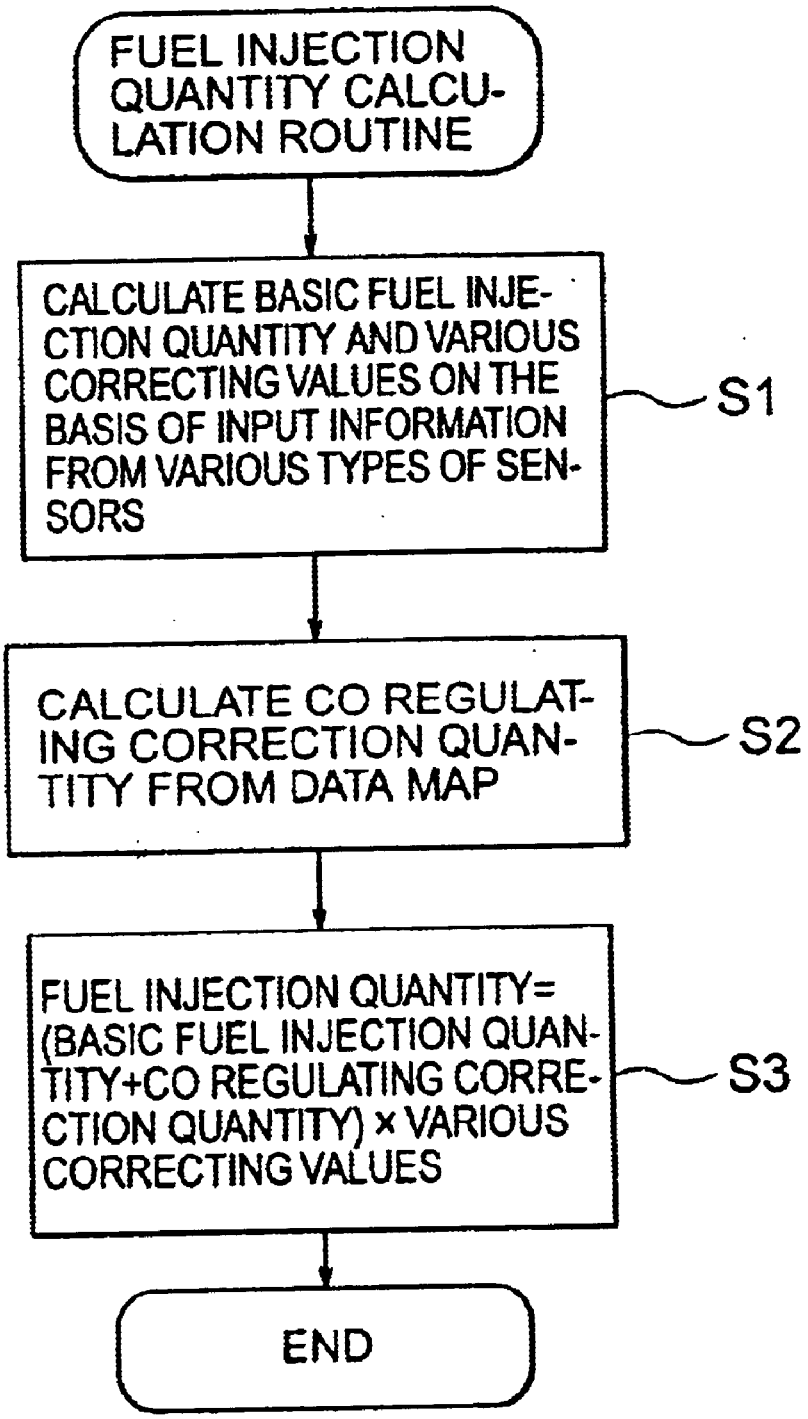
PRIOR ART FIG. 5
FIG. 5 is a flowchart for illustrating a fuel injection quantity calculation routine in a conventional fuel injection apparatus for the internal combustion engine.

FIG. 1 is a flow chart for illustrating the fuel injection quantity calculation routine in the fuel injection apparatus for the internal combustion engine according to the first embodiment of the invention. In the figure, steps S1 to S3 are directed to the essentially same processings as those described previously by reference to FIG. 5. Further, FIG. 2 is a view for illustrating a data map of CO regulating correction quantities in the fuel injection apparatus for the internal combustion engine according to the first embodiment of the invention, and FIG. 7 is a view for illustrating the CO regulating correction quantities (data values) at various points in the data map shown in FIG. 2.

Figures 2, 3:
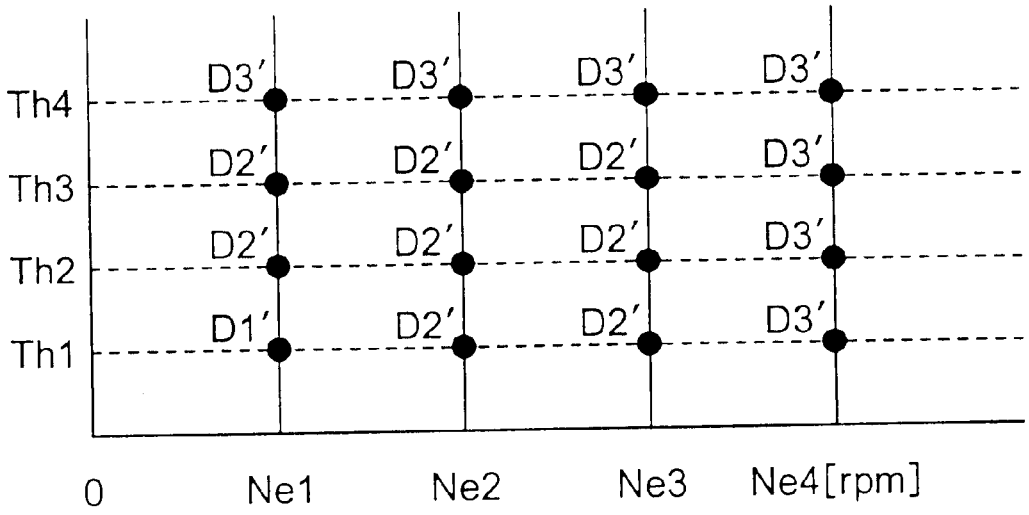
FIG. 2 is a view for illustrating a data map of CO regulating correction quantities employed in the fuel injection apparatus for the internal combustion engine according to the first embodiment of the invention.
FIG. 3 is a view for illustrating data of the CO regulating correction quantity data at various points in the data map shown in FIG. 2.
Figures 6, 7:
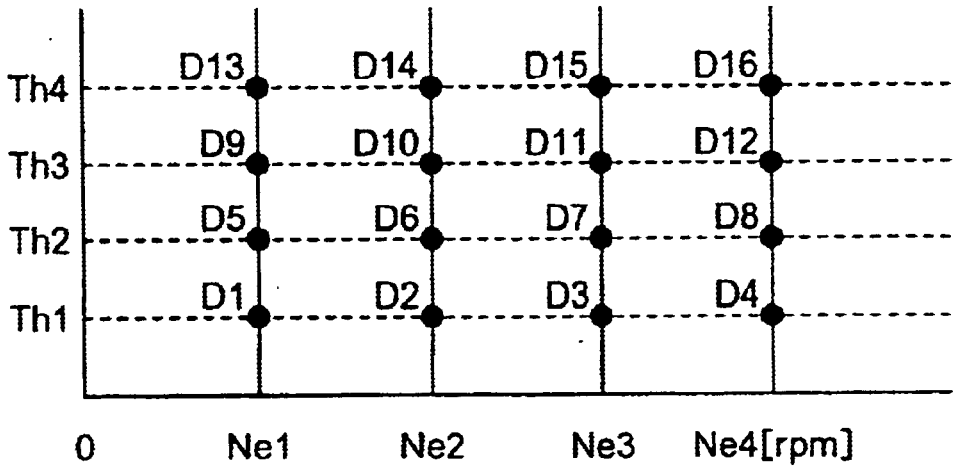
PRIOR ART FIG. 6
PRIOR ART FIG. 7
FIG. 6 is a view for illustrating a data map of CO regulating correction quantities in the conventional fuel injection apparatus for the internal combustion engine.
FIG. 7 is a view for illustrating data of the CO regulating correction quantities at various points in the data map shown in FIG. 6.

Referring to FIGS. 2 and 3, it is presumed that the throttle opening degrees Th1 to Th4 and the engine rotation speeds Ne1 to Ne4 are of same values as those described hereinbefore by reference to FIGS. 6 and 7. In this case, data D1' to D3' corresponding to three areas, respectively, are stored in the data map.

The data map shown in FIGS. 2 and 3 is a three-dimensional data map containing the CO regulating correction quantities corresponding to the throttle opening degrees Th and the engine rotation speeds Ne, respectively, as elucidated previously.

In the individual areas of the data map, there are set the data D1', D2' and D3' on a one-by-one basis, wherein data in the intermediate areas shown in phantom are determined through the interpolation calculation based on the data values in the preceding and succeeding areas, respectively.

At this juncture, it should be added that the data D1' corresponds to the data D1 mentioned previously and assumes data values which correspond to the areas where the throttle opening degree is not greater than Th1 [deg] and where the engine rotation speed is not higher than Ne1 [rpm] (i.e., idling range and low-speed operation range), respectively.

On the other hand, the data D2' assume data values corresponding to the areas (steady operation range) where the throttle opening degree is in the range of Th2 to Th3 [deg] and where the engine rotation speed is in the range of Ne2 to Ne3 [rpm].

Further, the data D3' assume data values corresponding to the areas (high-speed operation range) where the throttle opening degree is not smaller than Th4 [deg] and where the engine rotation speed is not lower Ne4 [rpm].

On the other hand, in the intermediate areas other than the three areas mentioned above as indicated in phantom, the interpolation data are determined through the procedures mentioned below.

By way of example, in the area where the throttle opening degree is in the range of Th1 [deg] to Th2 [deg] and where the engine rotation speed is in the range of Ne1 [rpm] to Ne2

[rpm], the result of interpolation calculation performed by using the data D1' and D2' is determined as the interpolation data for the CO regulating correction quantity.

Similarly, in the areas where the throttle opening degree is in the range of Th3 [deg] to Th4 [deg] and where the engine rotation speed is in the range of Ne3 [rpm] to Ne4 [rpm], the result of interpolation calculation performed by using the data D2' and D3' is determined as the interpolation data for the CO regulating correction quantity.

Parenthetically, on the precondition that the throttle opening degrees Th1 to Th4 satisfy the relation mentioned previously (i.e., Th1<Th2<Th3<Th4), the throttle opening degree Th1 may be set, for example, to a value not exceeding 15 degrees, while the range of the throttle opening degrees Th2 to Th3 may be each set, for example, to the range of 5 [deg] to 45 [deg] with the throttle opening degree Th4 being set within a range exceeding 20 [deg].

Similarly, on the precondition that the engine rotation speeds Ne1 to Ne4 satisfy the relation mentioned previously (i.e., Ne1<Ne2<Ne3<Ne4), the engine rotation speed Ne1 may be set, for example, to the range not exceeding 3500 [rpm], while the engine rotation speeds Ne2 and Ne3 are set, for example, within the range of 1500 [rpm] to 5000 [rpm] with the engine rotation speed Ne4 being set in the range which exceeds 4500 [rpm].

The set values and the data (CO regulating correction quantities) D1' to D3' in the individual areas are determined by taking into consideration of the operation states which exert influence to the concentration of CO contained in the exhaust gas due to dispersion among the various types of sensors 10.

More specifically, the data D1' in the idling mode and the low-speed operation mode is determined by taking into account the fact that the operation state which exerts a greatest influence to the concentration of CO contained in the exhaust gas takes place in the starting mode, idling mode and low-speed operation mode.

On the other hand, in the steady operation mode or range and the high-speed operation range, the engine operation is ordinarily so controlled that the concentration of CO in the exhaust gas is suppressed to a minimum. Consequently, the influence of the dispersion mentioned above is less significant when compared with the low-speed operation mode of the engine. However, because correction of the concentration of CO may be required due to other factors, the data D2' and D3' for the CO regulating correction quantity are determined by taking into account this fact.

Next, referring to FIGS. 1 to 4, description will be directed to the fuel injection quantity control operation of the fuel injection apparatus for the internal combustion engine according to the first embodiment of the present invention.

First referring to FIG. 1, the basic fuel injection quantity and the various correcting values are arithmetically determined on the basis of the current engine operation state (step S1), whereon decision is made as to whether or not the operation state corresponds to the intermediate area in the data map (see FIG. 2) in a step S11.

When it is decided in the step S11 that the current engine operation state lies in the area in which the data is set and not in the intermediate area (i.e., when the decision step S11 results in negation "NO"), the procedure proceeds to the aforementioned fuel injection quantity arithmetic processing (step S2, S3).

By contrast, when it is decided in the step S11 that the current engine operation state corresponds to the intermediate area (i.e., when the result of the decision step S11 is affirmation "YES"), the interpolation data is arithmetically determined by using the data in the two adjacent areas (step S12), whereon the interpolation data is adopted as the CO regulating correction quantity relevant to the intermediate area (step S13), and thus the processing proceeds to the fuel injection quantity arithmetic processing (step S3).

In succession, the fuel injection quantity is adjusted or regulated with the CO regulating correction quantity to thereby compensate for dispersions of the engine and the various sensors 10. In this way, the fuel injection control conforming to the engine operation state can be performed with enhanced accuracy.

By determining the data for the intermediate area through the interpolation calculation based on the two preceding and succeeding areas, the number of the data (data quantity) stored in advance in the EEPROM 21 upon shipping of the engine can remarkably be decreased.

In other words, by structuring the map data for the CO regulating correction quantity in such a manner as illustrated in FIG. 2, data can be set to a lesser number of areas when compared with the conventional map data set on a point-by-point basis (see FIG. 6).

By way of example, in the case of the map data shown in FIG. 2, the number of the data to be held in the EEPROM 21 upon shipping of the engine can be decreased to three from sixteen.

Incidentally, the various correcting values and the interpolation data may be calculated in the steps S1 and S2 every time the engine operation state is detected and need not be stored in the EEPROM 21. Accordingly, the EEPROM 21 can be implemented with a small capacity, advantageously from the view point of the cost.

Further, by structuring the areas corresponding to the data D2' and D3', respectively, in an L-like shape (see FIG. 2), the three-dimensional data map bearing correspondence to both the throttle opening degree Th and the CO regulating correction quantity with the same number of the data of the two-dimensional data map bearing correspondence only to the throttle opening degree Th or alternatively the engine rotation speed Ne [rpm] can be employed, whereby the data storage capacity can be reduced while ensuring correction for various dispersions with high accuracy.

Thus, the storage capacity of the EEPROM 21 can significantly be reduced while the time taken for the data input operation of the CO regulating correction quantity (data alteration for the CO regulating correction quantity and data writing) can remarkably be decreased.

Besides, because the time demanded for searching the data map for the CO regulating correction quantity can also be reduced, the proceeding load imposed on the microcomputer 20 can be mitigated.

In the foregoing description of the fuel injection apparatus for the internal combustion engine, carbon monoxide is used as the regulation parameter with the throttle opening degree Th and the engine rotation speed Ne [rpm] being used as the regulation parameters for setting data for the CO regulating correction quantity. However, it goes without saying that the map may equally be set by using data of other operation state parameters.

Further, although the final fuel injection quantity is arithmetically determined by adding the CO regulating correction quantity to the basic fuel injection quantity, it is selfseplantory that the basic fuel injection quantity may be multiplex by the CO regulating correction quantity, substantially to the same.

As is apparent from the foregoing description, the present invention has provided the fuel injection apparatus for an internal combustion engine, which apparatus includes various types of sensors for detecting operation state of the internal combustion engine, the control unit for arithmetically determining the fuel injection quantity to be injected into the internal combustion engine in dependence on the engine operation state, and the fuel injector for injecting the fuel into the internal combustion engine in conformance with the fuel injection quantity determined arithmetically, wherein the control unit is constituted by the basic fuel injection quantity arithmetic means for arithmetically determining the basic fuel injection quantity in dependence on the engine operation state, the data map means for holding a plurality of data for determining the regulating correction quantity in dependence on specific parameters of the engine operation state, and the correcting arithmetic means for determining the fuel injection quantity by correcting the basic fuel injection quantity with the data. The data map means mentioned above includes a plurality of areas for holding the data, and the plural areas have intermediate areas holding no data between two adjacent data holding areas. The correcting arithmetic means includes the map search means for arithmetically determining interpolation data corresponding to the intermediate area through interpolation arithmetic based on the data stored in the two adjacent areas. The fuel injection quantity corresponding to the intermediate area is determined by correcting the basic fuel injection quantity with the interpolation data. By virtue of the arrangement of the fuel injection apparatus according to the present invention described above, the number of data to be held can significantly be decreased, allowing the apparatus to be implemented at a low cost without impairing the fuel injection control accuracy. Besides, the data input processing and the data search processing can be mitigated.

In the fuel injection apparatus according to the present invention, the data mentioned above correspond to the CO regulating correction quantity for reducing the discharge quantity of carbon monoxide contained in the exhaust gas of the internal combustion engine. The specific parameters include the throttle opening degree and the engine rotation speed [rpm] of the internal combustion engine. The data map means holds the CO regulating correction quantity which corresponds to the throttle opening degree and the engine rotation speed [rpm] in the form of the three-dimensional data map. Owing to this arrangement, the number of data to be held can be decreased without exerting no adverse influence to the fuel injection control accuracy, and thus the apparatus can be implemented in a low cost. Additionally, the data input processing and the data search processing can be mitigated.

Further, in the fuel injection apparatus according to the present invention, the correcting arithmetic means is so designed as to arithmetically determine the fuel injection quantity by adding the data or alternatively the interpolation data to the basic fuel injection quantity. By virtue of this feature, the number of data to be held can be decreased without exerting no adverse influence to the fuel injection control accuracy, and thus the apparatus can be implemented in a low cost. Besides, the data input processing and the data search processing can be mitigated.

Furthermore, in the fuel injection apparatus according to the present invention, the plural areas mentioned above include first, second and third areas determined by a first throttle opening degree, a second throttle opening degree greater than the first throttle opening degree, a third throttle opening degree greater than the second throttle opening degree and a fourth throttle opening degree greater than the third throttle opening degree, and a first engine rotation speed, a second engine rotation speed higher than the first engine rotation speed, a third engine rotation speed higher than the second engine rotation speed, and a fourth engine rotation speed higher than the third engine rotation speed. In that case, the first area is constituted by an area where the throttle opening degree is not greater than the first throttle opening degree and where the above-mentioned engine rotation speed is not higher than the first engine rotation speed [rpm]. The second area is constituted by an area where the above-mentioned throttle opening degree lies within a range of the second and third throttle opening degrees and where the engine rotation speed lies within a range of the above-mentioned second and third engine rotation speeds. The third area is constituted by an area where the throttle opening degree is not smaller than the fourth throttle opening degree and where the engine rotation speed is not lower the fourth engine rotation speed. By virtue of the arrangement of the fuel injection apparatus according to the present invention described above, the number of data to be held can significantly be decreased, allowing the apparatus to be implemented at a low cost without impairing the fuel injection control accuracy. Besides, the data input processing and the data search processing can be mitigated.

Many modifications and variations of the present invention are possible in the light of the above techniques. It is therefore to be understood that within the scope of the appended claims, the invention may be practiced otherwise than as specifically described.

What is claimed is:

1. A fuel injection apparatus for an internal combustion engine, comprising:

various types of sensors for detecting operation state of said internal combustion engine;

a control unit for arithmetically determining a fuel injection quantity to be injected into said internal combustion engine in dependence on said engine operation state; and a fuel injector for injecting the fuel into said internal combustion engine in conformance with said fuel injection quantity determined arithmetically, said control unit being comprised of:

basic fuel injection quantity arithmetic means for arithmetically determining a basic fuel injection quantity in dependence on said engine operation state;

data map means for holding a plurality of data for determining a regulating correction quantity in accordance with specific parameters of said engine operation state; and correcting arithmetic means for determining said fuel injection quantity by correcting said basic fuel injection quantity with said data, wherein said data map means includes:

a plurality of areas for holding said data, said plurality of areas having intermediate areas holding no data between two adjacent data holding areas, wherein said correcting arithmetic means includes:

map search means for arithmetically determining interpolation data corresponding to said intermediate area through interpolation arithmetic based on the data stored in said two areas, and wherein the fuel injection quantity corresponding to said intermediate area is determined by correcting said basic fuel injection quantity with said interpolation data.

2. A fuel injection apparatus for an internal combustion engine according to claim 1, wherein said data corresponds to a carbon monoxide regulating correction quantity for reducing a discharge quantity of carbon monoxide contained in the exhaust gas of said internal combustion engine, wherein said specific parameters includes a throttle opening degree and an engine rotation speed [rpm] of said internal combustion engine, and wherein said data map means holds said carbon monoxide regulating correction quantities corresponding to said throttle opening degrees and said engine rotation speeds, respectively, in the form of a three-dimensional data map.

3. A fuel injection apparatus for an internal combustion engine according to claim 1, wherein said correcting arithmetic means is designed to arithmetically determine said fuel injection quantity by adding said data or alternatively said interpolation data to said basic fuel injection quantity.

4. A fuel injection apparatus for an internal combustion engine according to claim 1, said plurality of areas including first, second and third areas determined by a first throttle opening degree, a second throttle opening degree greater than said first throttle opening degree, a third throttle opening degree greater than said second throttle opening degree and a fourth throttle opening degree greater than said third throttle opening degree, and a first engine rotation speed, a second engine rotation speed higher than said first engine rotation speed, a third engine rotation speed higher than said second engine rotation speed and a fourth engine rotation speed higher than said third engine rotation speed, wherein said first area is constituted by an area where said throttle opening degree is not greater than said first throttle opening degree and where said engine rotation speed is not higher than said first engine rotation speed [rpm], wherein said second area is constituted by an area where said throttle opening degree lies within a range of said second and third throttle opening degrees and where said engine rotation speed lies within a range of said second and third engine rotation speeds, and wherein said third area is constituted by an area where said throttle opening degree is not smaller than said fourth throttle opening degree and where said engine rotation speed is not lower said fourth engine rotation speed.

* * * * *